United States Patent [19]

Phillips

[11] Patent Number: 4,945,683

[45] Date of Patent: Aug. 7, 1990

[54] ABRASIVE BELT GRINDING MACHINE

[75] Inventor: James D. Phillips, Posen, Mich.

[73] Assignee: J. D. Phillips Corporation, Alpena, Mich.

[21] Appl. No.: 377,067

[22] Filed: Jul. 10, 1989

[51] Int. Cl.[5] ..... B24B 21/00

[52] U.S. Cl. ..... 51/145 R; 51/105 EC; 51/147

[58] Field of Search ..... 51/147, 101 R, 145 R, 51/105 EC, 141, 135 R

[56] References Cited

U.S. PATENT DOCUMENTS 4,833,834 5/1989 Patterson et al. ..... 51/147

*Primary Examiner*—Frederick R. Schmidt

*Assistant Examiner*—M. Rachuba

*Attorney, Agent, or Firm*—Barnes, Kisselle, Raisch, Choate, Whittemore & Hulbert

[57] ABSTRACT

Apparatus for grinding to predetermined contour a plurality of eccentric cams on a cam shaft, comprising abrasive belts supported adjacent the cam shaft for linear movement such that the belts grind the peripheries of the cams. The belts are guided along a variable path according to the cam contour desired by shoes engaging the belts at their points of contact with the cams. The shoes are mounted on actuators powered by motor units controlled by CNC controllers. A coolant distributor for each belt is capable of flexing the belt to compensate for shoe movement.

6 Claims, 4 Drawing Sheets

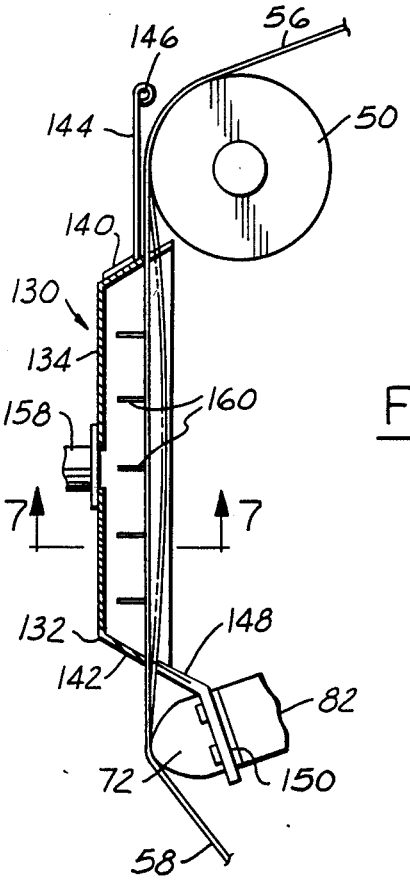
FIG.6
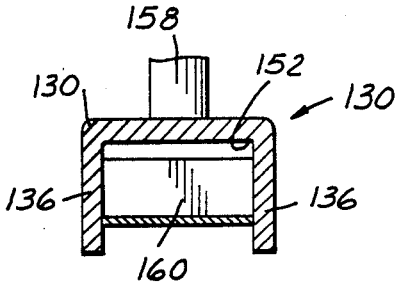
FIG.7
FIG.8
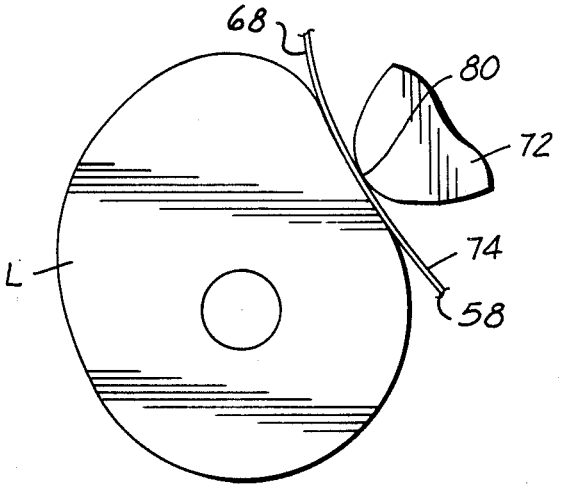

ABRASIVE BELT GRINDING MACHINE

This invention relates generally to grinding apparatus and refers more particularly to a machine for grinding a plurality of cams on a cam shaft by means of abrasive belts.

BACKGROUND AND SUMMARY OF THE INVENTION

Grinding cam lobes on a cam shaft is usually done by grinding wheels. In accordance with the present invention, the grinding of these cams is carried out by abrasive belts. This machine is more versatile in its ability to grind cams to almost any desired configuration than any machine of which I am aware. The belts are guided along a variable path according to the cam contour desired. Specifically, each belt is guided by a shoe which engages the back side of the belt at its point of contact with a cam periphery. Each shoe is mounted on one end of an elongated actuator which is moved longitudinally by a power unit. This power unit is CNC controlled to move the actuator along its longitudinal axis and cause the shoe to move the abrasive belt toward and away from the cam shaft axis.

In the specific embodiment described hereinafter, the actuators are guided for longitudinal movement by flexor units which urge the actuators in a direction away from the shaft axis.

In accordance with my specific design, the apparatus is intended to grind to predetermined contour a plurality of eccentric cams formed in axially spaced apart relation on an elongated cam shaft. Separate belts are provided for grinding each of the cams, and the shoes which guide the paths of the belts at their points of contact with the cam peripheries are CNC controlled independently of one another. Preferably, the shoes, actuators, and power units for longitudinally moving the actuators are disposed in different planes to permit relatively close grouping without interference.

The object of this invention is to provide a highly versatile and efficient cam grinding machine having the attributes referred to above and which is an improvement on past machines, examples of which are shown in the following U.S. Pat. Nos.:

1,660,291, Birkigt;
1,813,503, Merryweather;
1,843,301, Player, et al;
2,098,438, Stubbs;
2,195,054, Wallace, et al;
2,553,831, Musyl;
3,760,537, Bovatt;
4,091,573, Schmidt;
4,175,358, Bischeri;
4,292,767, Fatula;
4,382,727, Schmidt;
4,607,461, Adams;
4,833,834, Patterson;
British 2 073 069, Thielenhaus.

Other objects of this invention will become more apparent as the following description proceeds.

BRIEF DESCRIPTION OF THE DRAWINGS

FIG. 6 is a sectional view taken on the line 6—6 in FIG. 5.

FIG. 7 is a sectional view taken on the lines 7—7 in FIG. 6.

FIG. 8 is an enlarged view showing a shoe engaging the abrasive belt at its point of contact with a cam.

DETAILED DESCRIPTION

Figure 1:
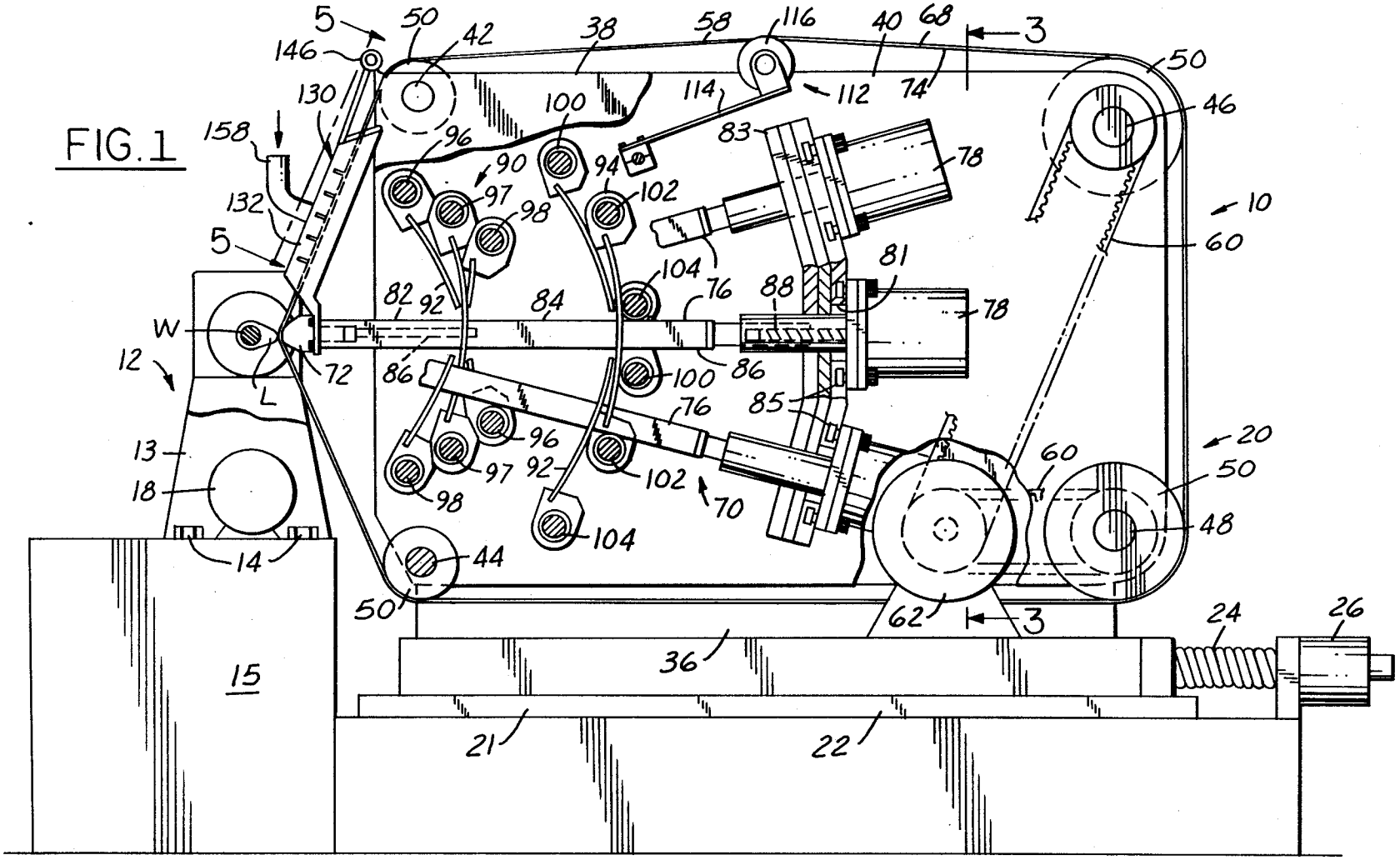
FIG. 1 is a side elevational view, with parts in section, of apparatus constructed in accordance with this invention.
Figure 2:
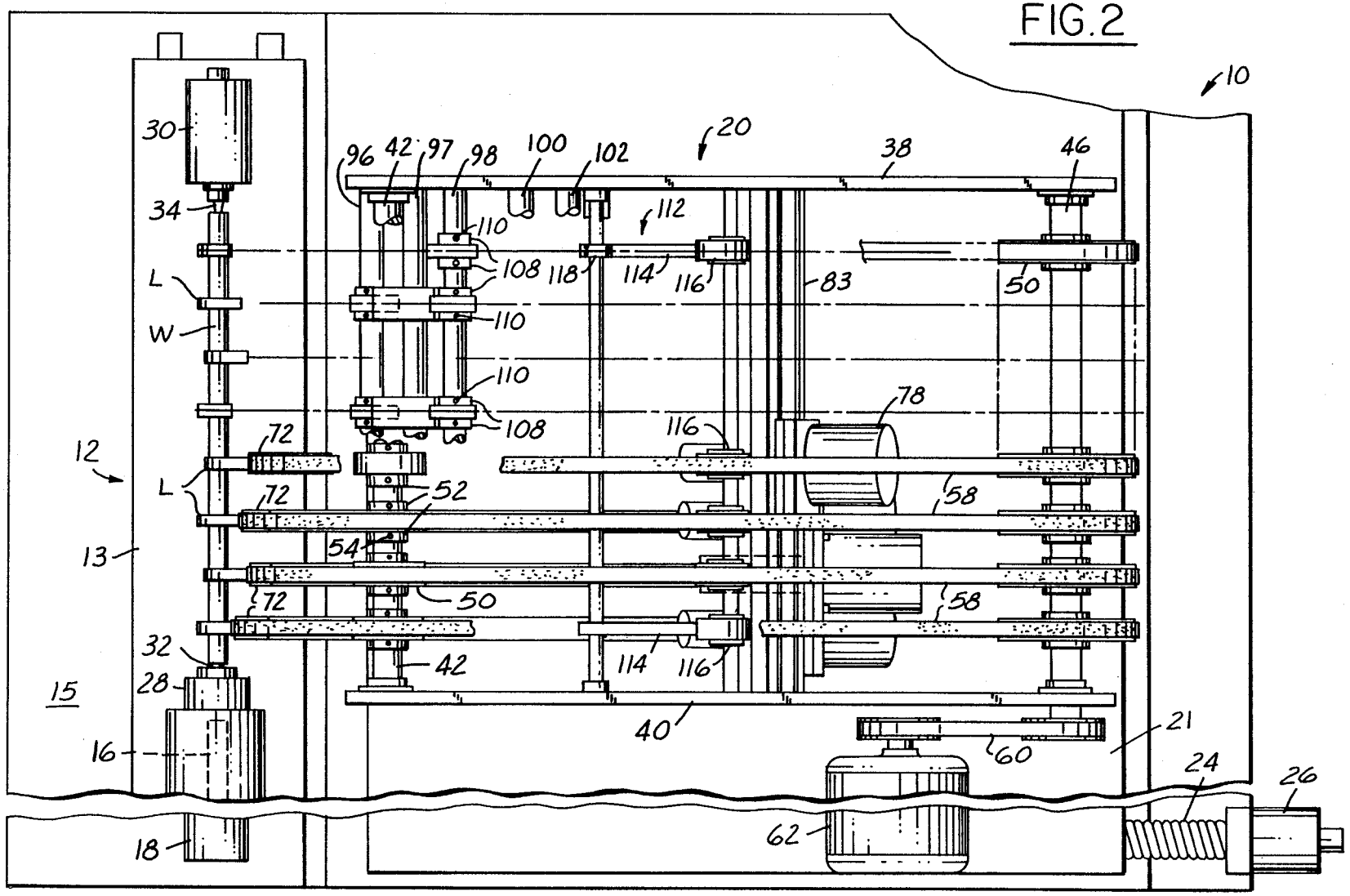
FIG. 2 is a top plan view, with parts broken away and with the coolant distributors removed for clarity, of the apparatus shown in FIG. 1.

Referring now more particularly to the drawings and especially to FIGS. 1 and 2, the numeral 10 designates a grinding machine having a workholding unit 12 comprising a table 13 slidably mounted on ways 14 on a supporting base 15 and movable to an adjusted position along the ways by means of a ball screw drive 16 powered by a reversible motor 18. The machine also has a grinding unit 20 comprising a table 21 slidably mounted on a lateral extension of the base 15 for movement along ways 22 which are at right angles to the ways 14. The grinding unit is movable toward and away from the workholding unit 12 by means of a ball screw drive 24 powered by a reversible motor 26.

The workholding unit 12 has a head stock 28 and a tail stock 30 located at opposite ends of the table 13, with aligned, confronting work supporting centers 32 and 34. The centers cooperate to engage and support an elongated workpiece W which in this instance is a cam shaft having numerous eccentric cams or cam lobes L formed in spaced apart relation along the length thereof.

Referring further to FIGS. 1 and 2, the grinding unit 20 has side frames 38 and 40 extending up from the table 21. Shafts 42 and 44 are secured to the side frames at their ends. Shafts 46 and 48 are rotatably connected to the side frames at their ends. Shafts 42–48 extend parallel to the cam shaft. Pulleys 50 are mounted on each shaft in spaced apart relation distances corresponding to the spacing between cams. The pulleys on the two shafts 42 and 44 are rotatably supported on the shafts and held in adjusted positions of alignment with the cams by collars 52 secured to the shafts by screws 54. The pulleys on the other two shafts 46 and 48 are secured to the shafts in adjusted positions of alignment with the cams by screws 56. Pulleys 50 on all four of the shafts are aligned with one of the cams and other pulleys 50 on the four shafts are aligned with each of the other cams. Abrasive belts 58 are trained over these aligned pulleys.

The shafts 46 and 48 are power driven by belts 60 from the motor 62 which extend over pulleys 64 and 66 secured to these shafts. The abrasive belts 58 have abrasive surfaces 68 adapted to grind the peripheries of the cams as they move past the cam shaft. The belts abrasive 58 are guided at their points of contact with the cam peripheries along a variable path according to the contour desired. Guiding is accomplished by a guiding mechanism 70 for each cam. Each guiding mechanism comprises a shoe 72 which engages the backing surface 74 of the belt opposite its grinding surface, an elongated actuator 76 and a motor 78.

The shoe 72 of each guiding mechanism has a rounded, blunt, convex nose 80 which engages the backing surface of a belt 58 (FIG. 8). Each actuator 76 has three sections 82, 84 and 86 secured together end-to-end (FIG. 1). A shoe 72 is secured to the outer end of the outer section 82 by any suitable means, not shown. The outer section 82 is secured to the intermediate section 84 by a fastener 86. The intermediate section 84 is secured to the inner section 86 by a similar fastener, not shown. The motor 78 moves the actuator 76 lengthwise in opposite directions by means of a ball screw drive 88 under the control of a CNC controller, not shown. Each motor 78 is CNC controlled independently of the others.

As apparent in FIG. 1, the actuators 76 are in three different planes at three different angles. All such planes intersect the axis of the cam shaft. Adjacent actuators are in different planes. The purpose of this arrangement is to enable closer grouping of the actuators without interference.

Figure 3:
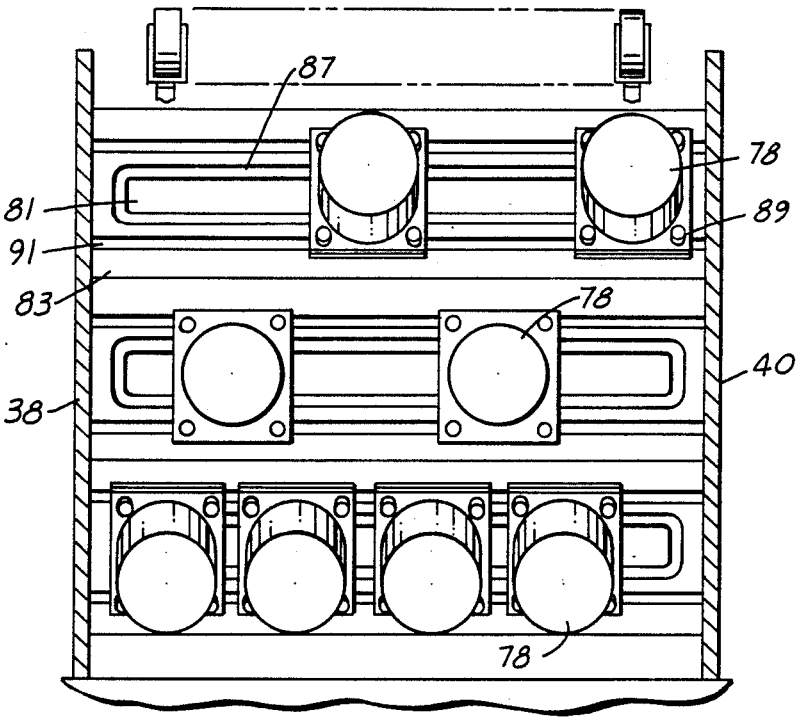
FIG. 3 is a view partly in section and taken on the line 3—3 in FIG. 1.
Figure 4:
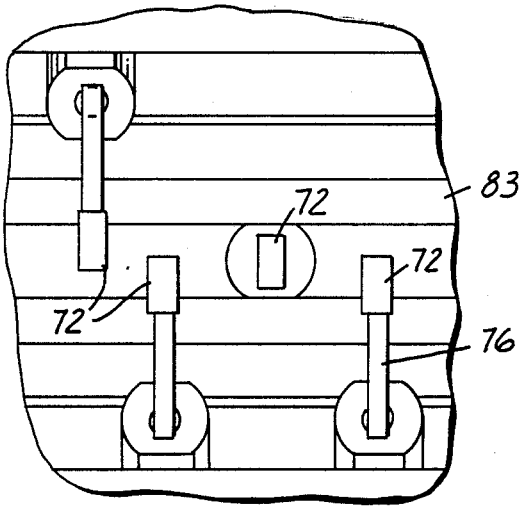
FIG. 4 is a partial front elevational view of the machine, with the flexor units removed for clarity.
Figure 5:
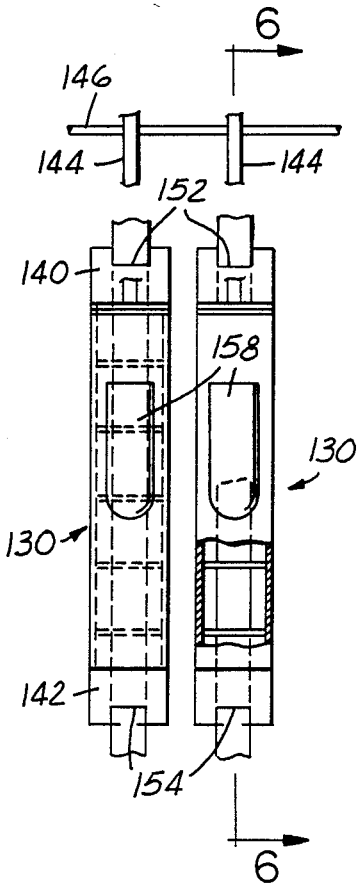
FIG. 5 is a view taken on the line 5—5 in FIG. 1.

The motors 78 are connected to the actuators 76 through elongated, horizontal openings 81 in a fixed frame 83 on the grinding unit 20 (FIGS. 1 and 3). The motors have T-shaped lugs 85 slidably engaging horizontal slots 87 in the fixed frame 83, and are secured in adjusted positions by screws 89 engaged in horizontal grooves 91.

The actuators are guided in their longitudinal movement by means of flexor units 90 (FIG. 1). There are two flexor units for each actuator, engaging and controlling the movement of the actuator at longitudinally spaced points. Each flexor unit has an elongated leaf spring 92. The leaf spring of one flexor unit for each actuator is clamped at its midpoint between the outer and intermediate sections of the actuator. The leaf spring of the other flexor unit for the same actuator is clamped at its midpoint between the intermediate and inner sections of the actuator.

The ends of the springs 92 are secured to brackets 94 which are rotatably mounted on shafts 96–104. Shafts 96–104 are parallel to shafts 42–48 and extend between and are secured to the side frames 38 and 40. The brackets for the two flexor units of the actuators in the upper plane are rotatably mounted on shafts 96 and 100. The brackets for the two flexor units of the actuators in the middle plane are rotatably mounted on shafts 97 and 102. The brackets for the flexor units of the actuators in the lower plane are rotatably mounted on shafts 98 and 104. All of the brackets 94 are located in adjusted position along the lengths of the shafts 96–104 by collars 108 on opposite sides thereof which are secured to the shafts by set screws 110.

A tensioning device 112 (FIG. 1) is provided for each abrasive belt. Each tensioning device comprises a leaf spring 114 having a roller 116 at one end in contact with the back of an abrasive belt. A clamp 118 on the opposite end of the leaf spring is secured to a rod 120 which is parallel to shafts 96–104 and is secured at its ends to the side frames 38 and 40. The clamps secure the respective tensioning devices in adjusted positions along the length of the rod so as to be aligned with the abrasive belts, and also in proper angular position to flex the springs and apply a proper tension on the abrasive belts.

A combination coolant distributor and belt compensator 130 is provided for each abrasive belt (FIGS. 1, 5, 6 and 7). Each coolant distributor and belt compensator comprises an elongated shallow trough-like receptacle 132 having a base 134, laterally spaced parallel side walls 136 and 138 and longitudinally spaced parallel end walls 140 and 142. The receptacle is open at the side opposite the base. The end wall 140 at the upper end has an extension 144 which is pivoted in adjusted position to a rod 146 that extends between and is secured to the side frames 38 and 40 and is parallel to the shafts 96–104. The end wall 142 at the lower end of each receptacle has an extension 148 which is secured to the shoe of an actuator at 150.

As shown in FIGS. 1 and 6, the coolant distributors 130 are located along the section of the abrasive belts between the shoes 72 and the pulleys 50 on shaft 42. The distributors extend lengthwise of this section of the belt with the open side of the distributor facing the belt. The abrasive belt moves through the distributor, entering a recess 152 in the top end wall and exiting through a recess 154 in the bottom end wall. The width of the distributor between the side walls and of the recesses in the end walls is substantially the same as the width of the belt. Thus, the belt sections pass through the distributors with their side edges in contact with the side walls 136 and 138 and with the opposite sides of the recesses 152 and 154 in the end walls, forming a substantially closed chamber 156 inside each receptacle on one side of the belt, with only slight leakage.

Liquid coolant, ordinary water for example, is supplied to the chamber 156 through an inlet 158 and builds up to a pressure on the order of about 30 psi. Liquid coolant is distributed more or less uniformly over the belt by means of the longitudinally spaced partitions 160 which extend transversely of the distributor and which are secured to the opposite side walls, but are spaced from the base of the distributor. The liquid coolant saturates the abrasive belt to condition it for better abrading action. Also, the pressure of fluid within the chamber will cause the belt to flex into the dotted line configuration shown. This adds to the tension in the belt and compensates for the slight tendency of the belt to stretch as the shoe moves in and out. The bowing of the belt by the liquid coolant pressure provides an almost instantaneous response to take in and let out on the belt as the shoe moves.

As the belt actuators move in and out to properly position the belt when in contact with the cam lobes (the actuator moving back and forth usually through a distance of about ¼" to 1"), the coolant distributors follow this movement because they are connected to the shoes on the actuators.

In operation, and with a cam shaft supported on centers 32 and 34, the belts 58, tensioning devices 112, distributors 130 and belt guiding mechanism 70 on the grinding unit 20 are adjusted to match the spacing of the cams. The workholding unit 12 and grinding unit 20 are positioned so that the belts 58 are close to the cams as shown in FIG. 2. The cam shaft is rotated. The belts are driven by the motor 62. The belts are guided at their points of contact with the cam peripheries by the shoes 72 which are moved in and out by the actuators 76 and CNC controlled motors 78 according to the cam contour desired. The motors are independently controlled.

This machine will profile grind all of the cams on a cam shaft simultaneously in 10 to 45 seconds, and is capable of grinding even small re-entry radii in the cams.

I claim:

1. Apparatus for grinding to predetermined contour a plurality of eccentric cams formed in axially spaced apart relation on an elongated camshaft, comprising means for supporting and rotating the camshaft about its longitudinal axis, a plurality of flexible, abrasive belts each having an abrasive surface and a backing surface opposite said abrasive surface, means supporting said belts adjacent the camshaft opposite the respective cams for linear movement such that the abrasive surfaces of said belts grind the peripheries of said cams, and means for guiding each belt at its point of contact with a cam periphery along a variable path according to the cam contour desired as said belt moves and the camshaft rotates, said guiding means for each belt comprising a shoe engaging the backing surface of said belt at its point of contact with a cam periphery, means for moving each shoe toward and away from the camshaft axis independently of the movement of the other shoes, said means for moving each shoe comprising an elongated actuator to one end of which one of said shoes is attached, a power unit attached to the opposite end of each actuator for longitudinally moving said actuators, and means for supporting said actuators in relatively closely spaced relationship for longitudinal movement along lines which intersect the axis of rotation of the camshaft and with adjacent actuators disposed at an angle to one another to permit said relatively close spacing without interference between adjacent actuators and power units.

2. Apparatus as defined in claim 1, wherein said supporting means for said actuators comprise spring flexor units each including a leaf spring connected at its midsection to an actuator, and means mounting the ends of said leaf springs.

3. Apparatus as defined in claim 2, including spaced shafts extending parallel to the axis of the camshaft, pulleys on said shafts over which said belts extend, and additional spaced shafts extending parallel to the axis of the camshaft, said leaf spring mounting means being mounted on said additional shafts.

4. Apparatus as defined in claim 3, including means for locating said pulleys on said first-mentioned shafts in adjusted positions longitudinally thereof to align said belts with the cams on the camshaft, means for locating said leaf spring mounting means on said additional shafts in adjusted positions longitudinally thereof to align said actuators with said belts, and means for mounting said power units in adjusted positions corresponding to the positions of said actuators.

5. Apparatus as defined in claim 4, including a combination coolant distributor and belt compensator for each said belt to saturate it with liquid coolant and compensate for shoe movement, each said coolant distributor and belt compensator comprising a receptacle having an open side, each said belt moving through one of said receptacles in contact with the walls thereof to provide a substantially closed chamber in said receptacle on one side of said belt, and means for supplying coolant under pressure to each said chamber to saturate the belt passing therethrough and flex the same by the pressure of coolant in contact therewith to compensate for shoe movement.

6. Apparatus for grinding to predetermined contour a plurality of eccentric cams formed in axially spaced apart relation on an elongated camshaft, comprising means for supporting and rotating the camshaft about its longitudinal axis, a plurality of flexible, abrasive belts each having an abrasive surface and a backing surface opposite said abrasive surface, means supporting said belts adjacent the camshaft opposite the respective cams for linear movement such that the abrasive surfaces of said belts grind the peripheries of said cams, and means for guiding each belt at its point of contact with a cam periphery along a variable path according to the cam contour desired as said belt moves and the camshaft rotates, said guiding means for each belt comprising a shoe engaging the backing surface of said belt at its point of contact with a cam periphery, means for moving each shoe toward and away from the camshaft axis independently of the movement of the other shoes, a combination coolant distributor and belt compensator for each said belt to saturate it with liquid coolant and compensate for shoe movement, each said coolant distributor and belt compensator comprising a receptacle having an open side, each said belt moving through one of said receptacles in contact with the walls thereof to provide a substantially closed chamber in said receptacle on one side of said belt, and means for supplying coolant under pressure to each said chamber to saturate the belt passing therethrough and flex the same by the pressure of coolant in contact therewith to compensate for shoe movement.

* * * * *